US009129586B2

(12) United States Patent
Bajic et al.

(10) Patent No.: US 9,129,586 B2
(45) Date of Patent: Sep. 8, 2015

(54) PREVENTION OF ANC INSTABILITY IN THE PRESENCE OF LOW FREQUENCY NOISE

(71) Applicant: Apple Inc., Cupertino, CA (US)

(72) Inventors: Vladan Bajic, San Francisco, CA (US); Thomas M. Jensen, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 286 days.

(21) Appl. No.: 13/709,919

(22) Filed: Dec. 10, 2012

(65) Prior Publication Data

US 2014/0072135 A1 Mar. 13, 2014

Related U.S. Application Data

(60) Provisional application No. 61/699,129, filed on Sep. 10, 2012.

(51) Int. Cl.
*G10K 11/00* (2006.01)
*G10K 11/178* (2006.01)

(52) U.S. Cl.
CPC ..... *G10K 11/002* (2013.01); *G10K 11/1784* (2013.01); *G10K 2210/1081* (2013.01); *G10K 2210/3028* (2013.01); *G10K 2210/30231* (2013.01); *G10K 2210/511* (2013.01)

(58) Field of Classification Search
None
See application file for complete search history.

(56) References Cited

U.S. PATENT DOCUMENTS 5,699,437 A 12/1997 Finn
7,536,018 B2 5/2009 Onishi et al.
8,243,941 B2 8/2012 Togawa et al.
2001/0053228 A1 12/2001 Jones
2002/0106091 A1* 8/2002 Furst et al. ..... 381/91
2008/0181422 A1 7/2008 Christoph
2008/0292113 A1* 11/2008 Tian ..... 381/98
2010/0014685 A1 1/2010 Wurm
2010/0061564 A1 3/2010 Clemow et al.
2010/0098263 A1 4/2010 Pan et al.
2010/0272283 A1 10/2010 Carreras et al.
2010/0296668 A1 11/2010 Lee et al.
2011/0007907 A1* 1/2011 Park et al. ..... 381/71.8

(Continued)

FOREIGN PATENT DOCUMENTS

EP 2395500 A1 12/2011

OTHER PUBLICATIONS

Kuo, Sen M., et al., "Active Noise Control: A Tutorial Review", Proceedings of the IEEE, vol. 87, No. 6, Jun. 1999, (pp. 943-973).

(Continued)

*Primary Examiner* — Brenda Bernardi
(74) *Attorney, Agent, or Firm* — Blakely, Sokoloff, Taylor & Zafman LLP

(57) ABSTRACT

An active noise control (ANC) processor has an adaptive filter that uses a reference signal to produce an anti-noise signal, and an error signal to evaluate cancellation performance. An adaptive filter algorithm engine configures the filter coefficients of the adaptive filter, in accordance with pre-shaped versions of the error and reference signals. The pre-shaping filter has a high-pass transfer function and enables the adaptive algorithm engine to increase noise cancellation performance in a high frequency band during the presence of focused or narrow-band noise energy in a low frequency band. Other embodiments are also described and claimed.

10 Claims, 10 Drawing Sheets

(56) References Cited

U.S. PATENT DOCUMENTS

| | | | | |
|---|---|---|---|---|
| 2011/0249826 | A1 | 10/2011 | Van Leest | |
| 2011/0293103 | A1 | 12/2011 | Park et al. | |
| 2011/0299695 | A1* | 12/2011 | Nicholson | 381/71.6 |
| 2012/0250873 | A1 | 10/2012 | Bakalos et al. | |
| 2012/0308024 | A1* | 12/2012 | Alderson et al. | 381/71.11 |
| 2012/0308025 | A1* | 12/2012 | Hendrix et al. | 381/71.11 |
| 2013/0301846 | A1* | 11/2013 | Alderson et al. | 381/71.7 |

OTHER PUBLICATIONS

Montazeri, Allahyar, et al., "Developing an IIR Robust Adaptive Algorithm in the Modified Filtered-x RLS Form for Active Noise and Vibration Control Systems", Dec. 2011, DOI: 10.1109/CDC2011.6161 in the proceedings of: 50th IEEE Conference on Decision and Control and European Control Conference, (6 pages).

* cited by examiner

PREVENTION OF ANC INSTABILITY IN THE PRESENCE OF LOW FREQUENCY NOISE

RELATED MATTERS

This application claims the benefit of the earlier filing date of provisional application No. 61/699,129, filed Sep. 10, 2012, entitled "Prevention of ANC Instability in the Presence of Low Frequency Noise".

FIELD

The embodiments of the invention relate to active noise control or active noise cancelling (ANC) systems that feature an adaptive filter and an adaptive filter controller.

BACKGROUND

In consumer electronics personal listening devices, such as smart phones and other audio devices that work with headsets, such as tablet computers and laptop computers, the listening device often does not have sufficient passive noise attenuation. For instance, a more comfortable loose fitting ear bud is often preferred, which provides lesser passive ambient noise reduction than a larger and heavier yet better sealed outside-the-ear unit, or a completely sealed in-ear earphone. In addition, a user is often moving around with the listening device, e.g. while walking or jogging. In the case of a smart phone that is being used in handset mode (against the ear), the phone is held against the user's ear differently by different users, and also tends to move around during a phone call. These user-specific factors change the acoustic environment or acoustic loading of the listening device in real-time. As a result, the use of an adaptive ANC system has been suggested, to help improve the user's listening experience by attempting to produce a quieter environment.

An ANC system produces an "anti-noise" sound wave in such a way, that is, having a certain spectral content, that is intended to destructively interfere with or cancel the ambient or background noise sound that would otherwise be heard by the user. Attempts have also been made to improve the performance of the ANC system in personal listening devices, by making the system adaptive. An adaptive filter and an adaptive controller are provided, which aim to model the different parts of the acoustic environment that is surrounding the user, or the various acoustic paths leading to the user's eardrum. Based on sensing the acoustic environment using at least a reference microphone and an error microphone, the ANC system adapts or continuously changes the state of its adaptive filter in real-time so as to produce an anti-noise signal that better cancels the offending or unwanted noise.

SUMMARY

It has been found that certain ANC systems do not respond well in the presence of background/ambient noise that has a focused or narrow-band, low frequency content. Examples of such narrow-band low frequency noise include car noise, such as when a user of a listening device is riding inside a car, bus, train or is otherwise in a similar environment in which the ambient noise has predominantly narrow-band and low frequency focused content. The adaptive algorithm tends to adapt incorrectly in the presence of such narrow-band or focused low frequency noise, because the algorithm operates by trying to produce an anti-noise that is intended to cancel the more dominant or more spectrally rich aspect of such ambient noise. The adaptive algorithm tries to configure the adaptive filter so as to model a narrow-band frequency response, in proportion to the energy of the detected noise, and will, as a result, not be sufficiently constrained in the rest of the audio band of interest. In so doing, the algorithm inadvertently "ignores" a high frequency band, which still needs adequate anti-noise in order to provide the user a comfortable listening experience. This problem may become worse particularly when the precision of the adaptive filter is limited in the low frequency band, due to practical limitations, for example, having a limited number of taps in a FIR filter implementation. This causes the accuracy of the adaptive filter to degrade in the low frequency band of interest, in this case, for example, between 5 Hz an 500 Hz.

An embodiment of the invention is an audio apparatus that has an ANC processor in which an adaptive filter is to use a reference microphone signal to produce an anti-noise signal. An adaptive filter algorithm engine is to configure the filter coefficients in accordance with signals at a first input and a second input. A first pre-shaping filter filters the reference signal for the first input of the engine, while a second pre-shaping filter filters the error signal for the second input of the engine. Each of the pre-shaping filters has a high pass transfer function that is designed to suppress energy in a low frequency band, relative to a high frequency band.

The pre-shaping filters together enable the engine to adapt the adaptive filter to thereby produce substantial anti-noise in the high frequency band, even during the presence of focused or narrow-band noise energy in the low frequency band. In other words, the pre-shaping filters prevent the narrow-band low frequency content from being passed to the computation engine of the adaptive filter algorithm. Experimental results have shown that such a technique may help prevent instability in the ANC processor, and may also increase noise cancellation performance within a high frequency band (and especially during the presence of focused or narrow-band ambient noise in a low frequency band). It has been found that the ambient noise's high energy content in the low frequency band will cause the adaptive filter algorithm engine to attempt to cancel such a signal, by producing the anti-noise primarily in that band, and as a result "ignoring" to a certain extent the rest of the audio band of interest. This problem is more serious when there is a lack of precision in the low frequency band, by the adaptive filter, e.g. because of the limited length of the adaptive filter. Also, in some personal listening devices, the acoustic response of the speaker that is used to audibilize the anti-noise signal tends to roll off substantially in the low frequency band. All of this means that allowing the adaptive engine to focus the anti-noise on the low frequency band is unlikely to yield a better overall noise cancellation experience for the user. In such a situation, the pre-shaping filters can help reshape the spectra of the reference and error signals that are used by the adaptive algorithm engine, to force the engine to avoid attempting to converge on a solution that is rich in low frequency content, and instead will force the engine to focus on the rest of the audio band of interest, and in particular the high frequency band where better cancellation performance may be available.

Note that there may be some trade off in that the components of the ambient noise that are within the low frequency band, namely below the knee of the high pass section of the transfer function of the pre-shaping filters, may not be effectively canceled by the ANC processor. However, the ANC system remains effective in the frequency range above the cut-off frequency of the high pass transfer function. Since the ANC system is not as effective in the low frequency band, due to the above-mentioned issues concerning limited adaptive filter length and roll off in the speaker response, the adaptive filter engine is thus steered into the more effective frequency band.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments of the invention with reference to the appended drawings are now explained. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known circuits, structures, and techniques have not been shown in detail so as not to obscure the understanding of this description.

Figure 1:
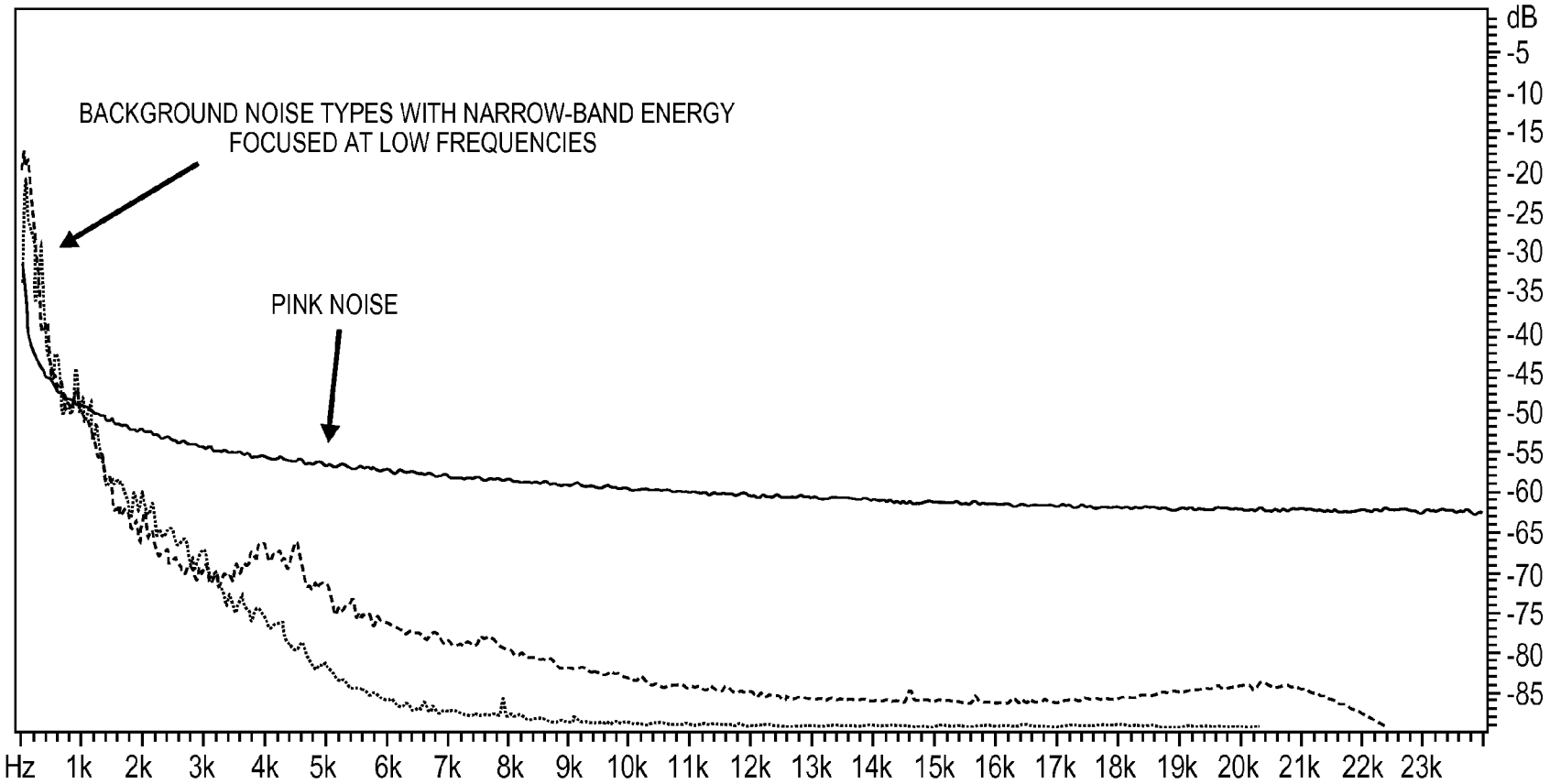
FIG. 1 shows plots of two different background noise-types being narrow-band or energy focused at low frequencies, as well as a plot of a pink noise environment.
Figure 2:
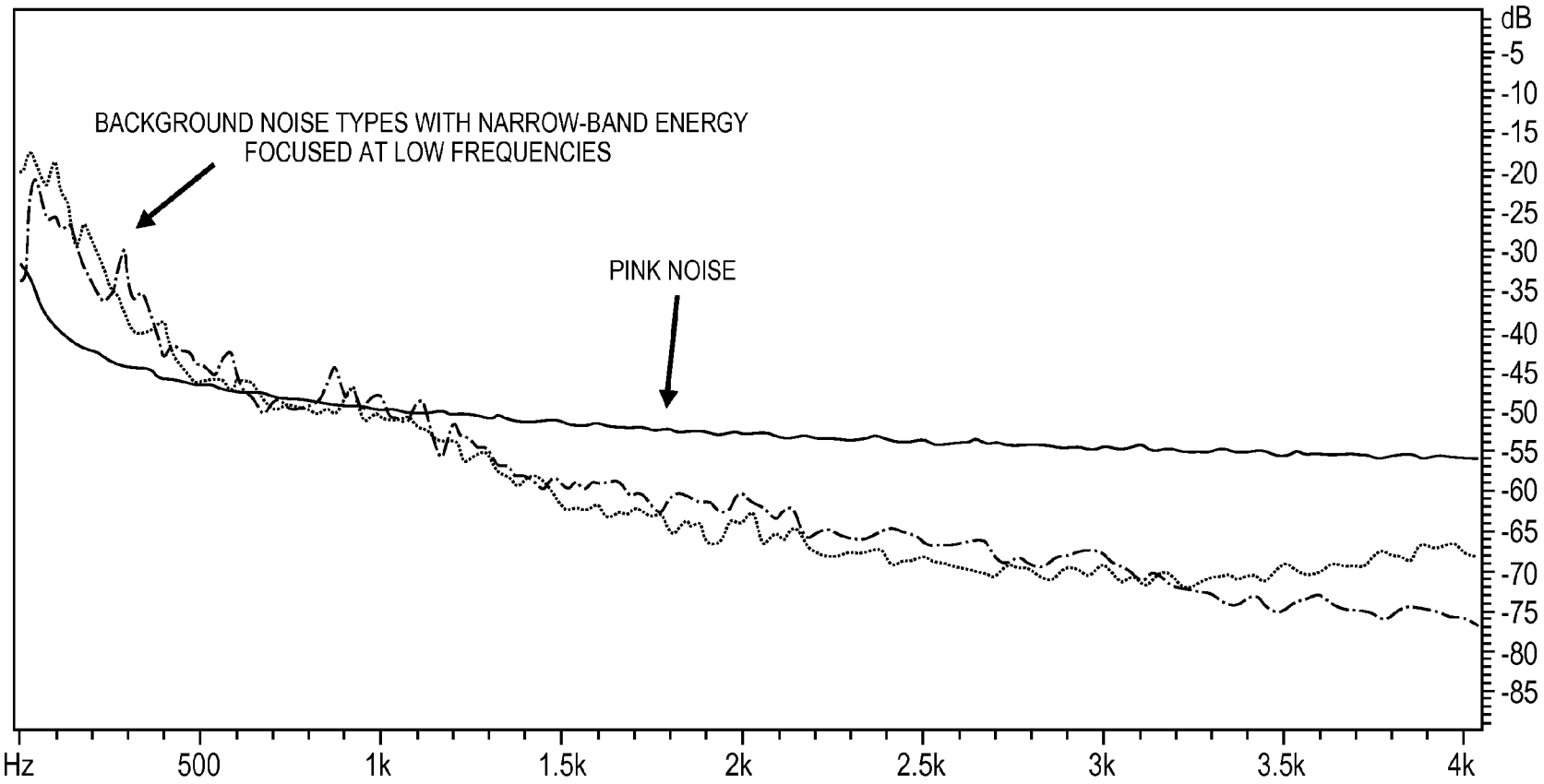
FIG. 2 is a plot of the noise-types depicted in FIG. 1 but with a close-up view of the full band of interest for an ANC system in a personal listening device.
Figure 3:
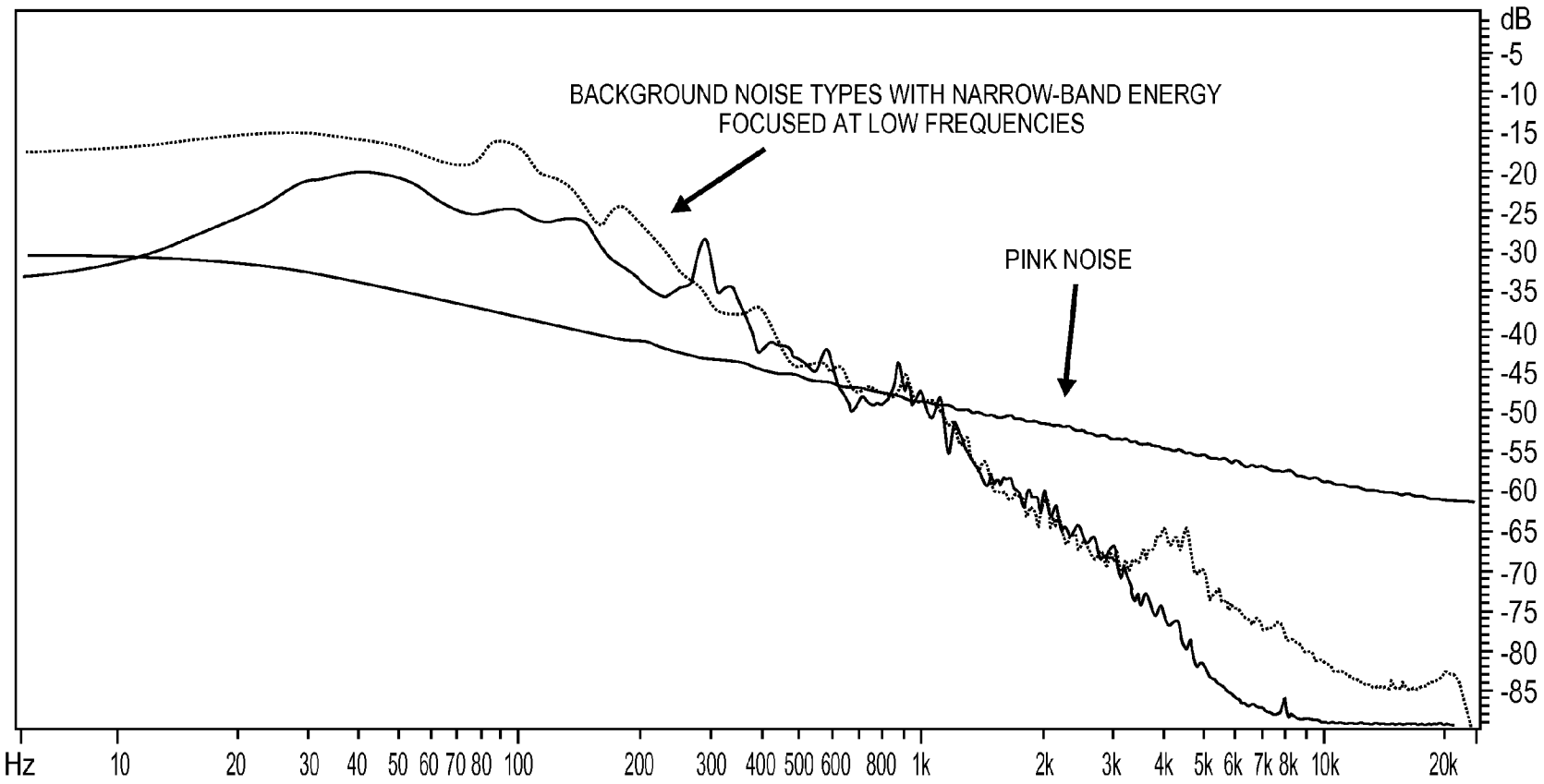
FIG. 3 shows another view of the plots of FIG. 1, using a logarithmic frequency scale.

FIG. 1 shows plots of three different example background noise-types, two being narrow-band or energy focused at low frequencies, and a pink noise environment. The plots show the noise characteristics over a broad spectrum, ranging from essentially zero Hz to over 20 kHz. The audible range of interest for an ANC system, however, is much smaller—see FIG. 2, which limits the view to 4 kHz. At best seen in the logarithmic scale plot of FIG. 3, in contrast to pink noise, the narrow-band or energy focused noise that is of interest contains the predominant part of, or substantially all of, its acoustic energy within about zero Hz to 400 Hz, or more specifically between about 1 Hz and 300 Hz. Examples of such narrow-band noise environments were given above and may include car noise as picked up by a microphone while inside a car that has a running combustion engine that is being driven, a similar arrangement in a bus, as well as in a train. More generally, however, the narrow-band noise of interest can be in another noise environment that presents a generally similar focused or emphasized spectrum whose energy is primarily in the range of up to 500 Hz. It can be seen in FIG. 3 more clearly that while pink noise tends to have a fairly gradual variation within the desired frequency range (for instance, up to 3 KHz), the narrow-band or energy focused noise exhibits sharper drop off.

Figure 4:
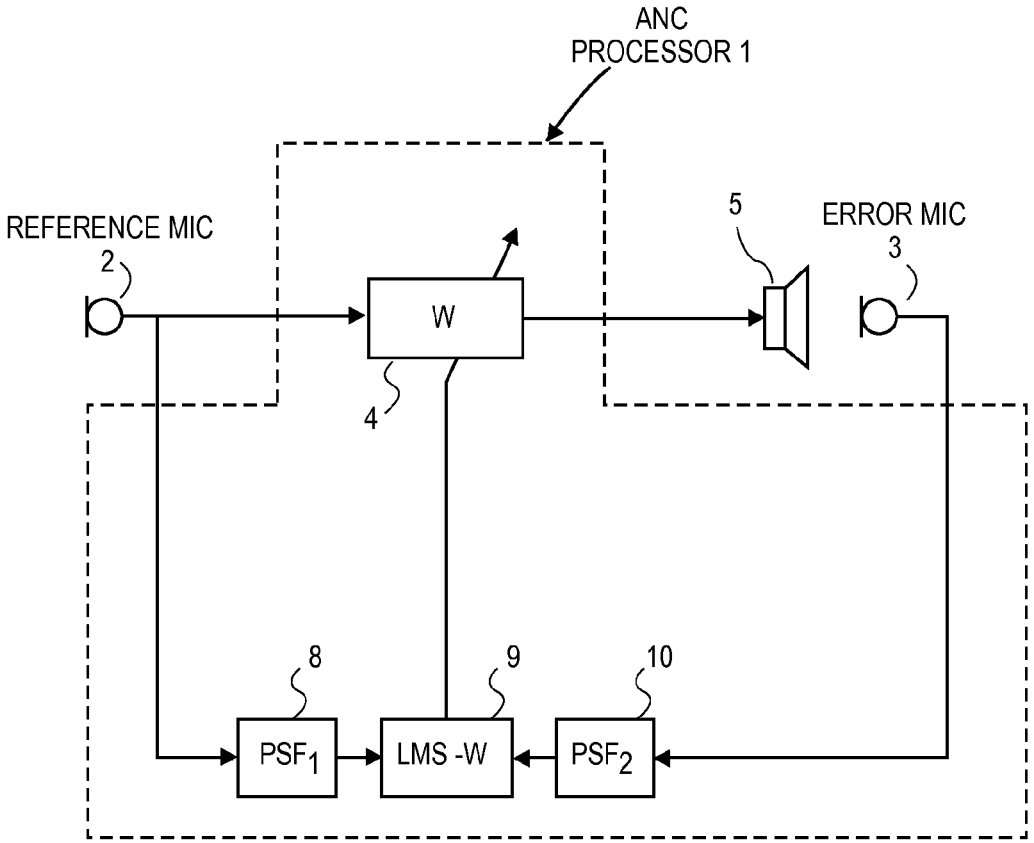
FIG. 4 is a block diagram of an ANC processor.

FIG. 4 illustrates a block diagram of an ANC processor 1 that may be able to better deal with the narrow-band ambient noise characteristics described above. The ANC processor 1 implements an adaptive active noise cancellation algorithm that continuously and repeatedly updates an adaptive filter 4(W). The latter models an acoustic system referred to as the "primary" path for ambient or background noise that reaches an ear of a user. This enables the adaptive filter 4 to be used to produce an anti-noise signal that is then driven through a speaker 5 as shown. The state of the adaptive filter 4 including its digital filter coefficients is repeatedly updated by an adaptive filter algorithm engine 9. The adaptive algorithm engine 9 may implement a gradient decent algorithm, e.g. least mean squares (LMS), which is designed to find the proper state or digital filter coefficients that tends to minimize the error between the anti-noise sound and the ambient or background noise. This error is reflected in a signal from an error microphone 3. In general, there may be more than one error microphone from which signals may be combined into a single error signal. A further input to the adaptive algorithm engine 9 is the audio signal picked up by one or more reference microphones 2, which reflects the ambient or background noise. While the LMS algorithm, and in particular, the filtered-x LMS algorithm, is described below in connection with FIG. 6 and FIG. 7, the use of high pass pre-shaping filters as described here may also be of benefit with other adaptive ANC algorithms.

The adaptive filter algorithm engine has at least two inputs, one to receive a filtered signal from the pre-shaping filter 8 (PSF_1), and a second input to receive a filtered signal from the pre-shaping filter 10 (PSF_2). Each of the pre-shaping filters has a high pass section in its transfer function that is designed to suppress energy in a low frequency band relative to the high frequency band. The transfer function of each filter (where these need not be identical but should be similar), should be selected in view of the particular narrow-band noise that is of concern, although the PSF_1, PSF_2 can be "always on" in that they need not be switched out when the ambient noise characteristics are different. It has been found that without the use of such pre-shaping filters, the ANC processor 1 may have very limited noise canceling ability across the full band (namely from about 5 Hz to about 4 kHz) in the presence of focused low frequency noise. In particular, performance appears to suffer significantly within 500 Hz and 1 kHz. As explained in the Summary section above, this may be due to the adaptive algorithm engine 9 being "overwhelmed" by the energy focused or narrow-band noise that is primarily within the low frequency band, namely less than 500 Hz and, in particular, between 5 Hz to 400 Hz.

Figure 5:
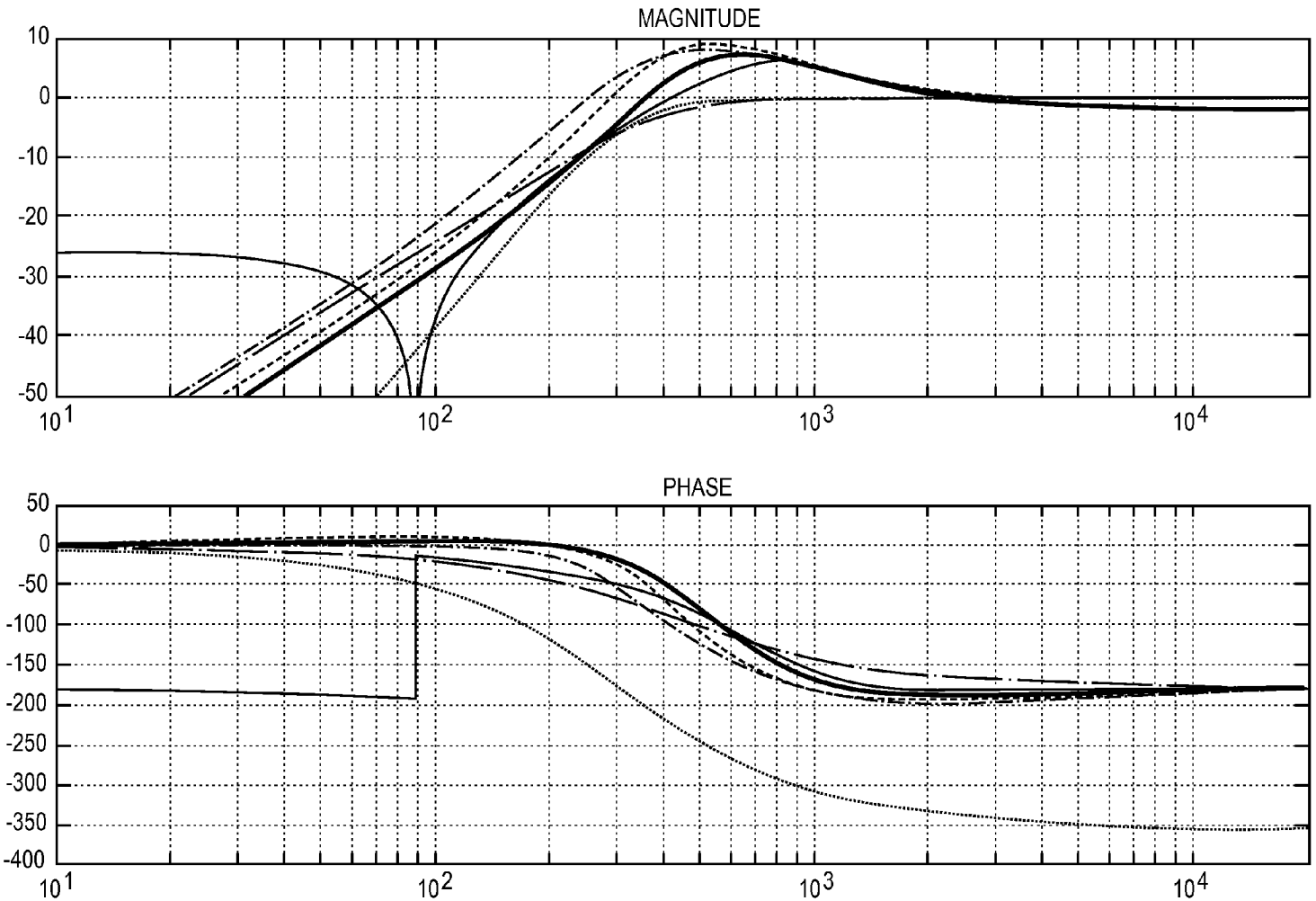
FIG. 5 shows simulated magnitude response and phase response spectra for several different pre-shaping filters.

A solution that may help the ANC processor 1 show better performance, that is better noise cancellation in the upper frequencies, may be to design the pre-shaping filters to have essentially high pass transfer functions, for example any of those depicted in FIG. 5. These have a knee or 3 dB cut-off at between 100 Hz and 400 Hz. Such a magnitude response is suitable were the power spectrum of the background/ambient noise is "narrow-band" in that it declines at a rate of 5 dB/octave or greater, above the frequency where the knee of the pre-shaping filter is located. See, e.g. the plots in FIGS. 1-3. Although the phase response is also shown in FIG. 5, it is the magnitude response that should be more carefully considered. In particular, as seen in the magnitude response plots, the high pass transfer function may have a roll-off slope between 10 dB per octave and 25 dB per octave.

In general, without the pre-shaping filters, the ANC processor 1 may be expected to be substantially less effective across the full band of ANC operation, e.g. from 100 Hz to 3,000 Hz, when there is focused noise energy that is narrow-band and that lies below approximately 400 Hz. In one embodiment, the low frequency band is defined as the smallest frequency band that contains substantially all of the energy of the ambient noise, for example, as measured through the reference microphone signal.

Figure 6:
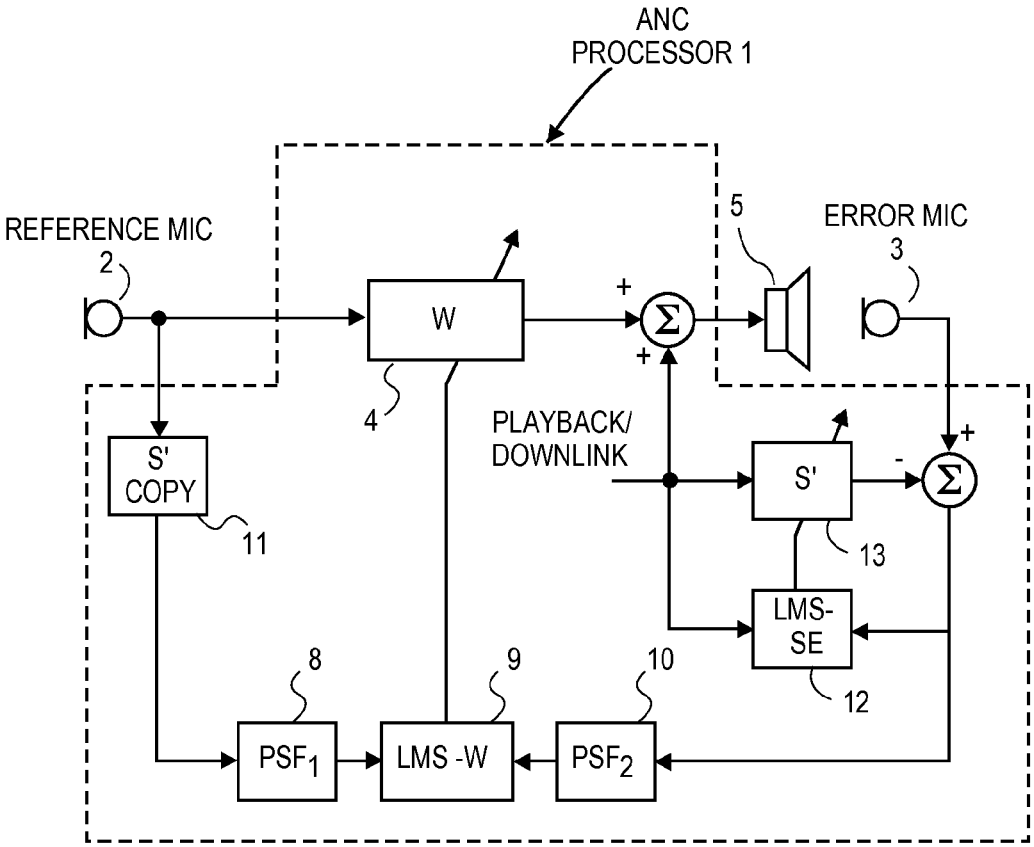
FIG. 6 is a block diagram of an ANC processor that uses a filtered-x LMS architecture.

Turning now to FIG. 6, this is a block diagram of an ANC processor 1 that uses a filtered-x LMS architecture. In the filtered-x LMS approach depicted here, the reference signal input to the algorithm engine 9 passes through a filter 11, before being passed through the PSF_1. The filter 11 may be essentially a copy of a filter 13, which is designed to model the "secondary" acoustic path, which is encompassed by the transfer function between the input to the speaker 5 and the output of the error microphone 3. In addition, the error signal input to the algorithm engine 9 is adjusted by the output of the filter 13, which represents removal of the contribution by the playback or downlink audio signal, from the sound picked up by the error microphone 3. A further adaptive algorithm engine 12 may be needed as shown, to adapt the secondary path adaptive filter 13 (S') because of expected changes in the secondary acoustic path (due to various user scenarios).

Figure 7:
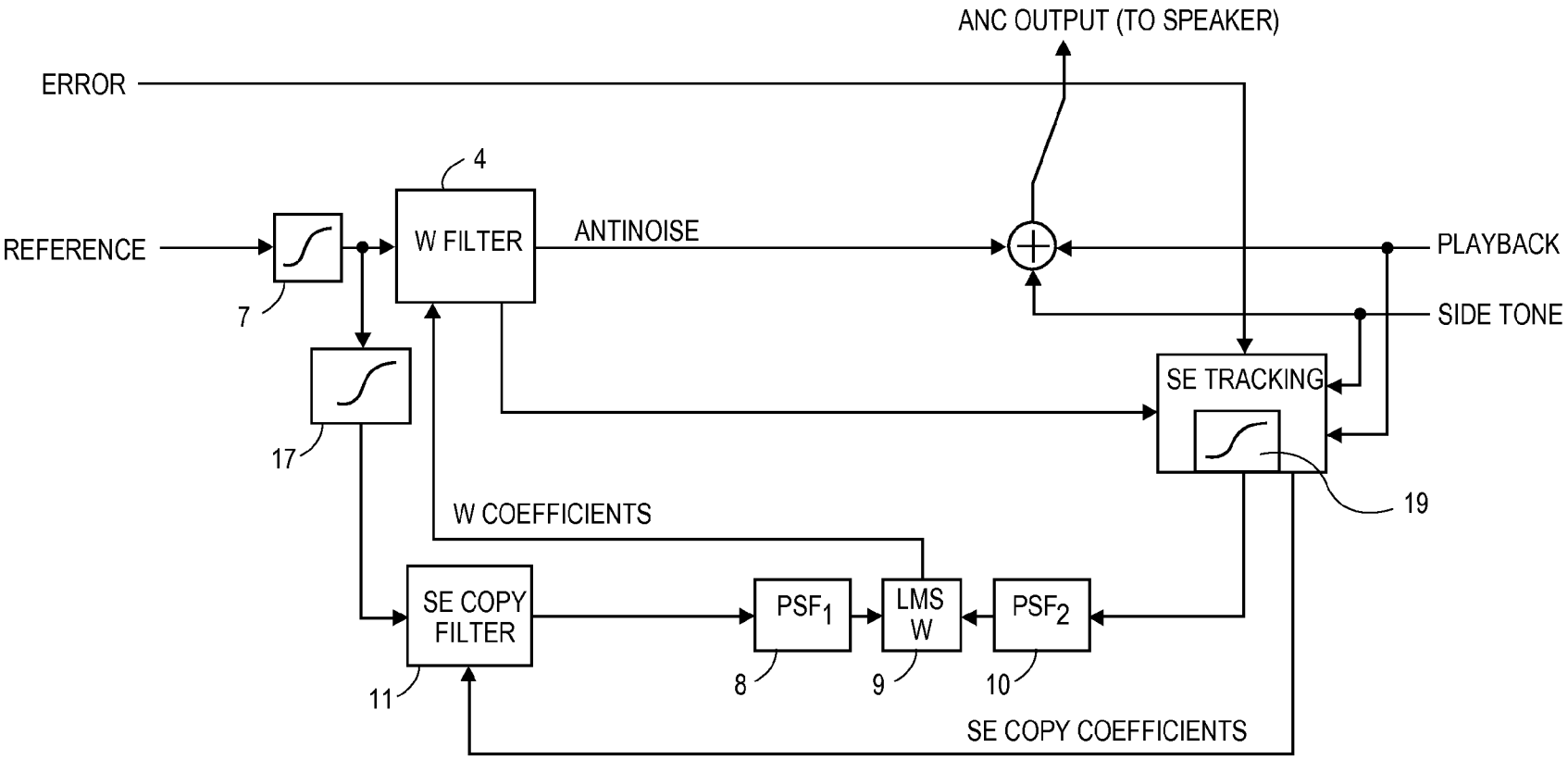
FIG. 7 illustrates a filtered-x LMS architecture with additional details.

FIG. 7 illustrates the filtered-x LMS architecture with additional details. This is a more detailed view of a filtered-x LMS embodiment of the ANC processor 1, where it can be seen that the reference signal (coming from the reference microphone 2) passes through a high-pass filter 7 before being fed to an input of the adaptive (W) filter 4. The high-pass filter 7 may be considered a DC blocking filter, that is a high-pass filter with very low frequency cut-off, e.g. having a filter knee of about 2 Hz, or less than 4 Hz. This very low frequency or DC blocking filter is desired so as to block very low frequency components from passing through the adaptive W filter 4 and into the speaker. Such very low frequency components are generally undesirable in a phone audio system, for example. Note that the filter knee of the high-pass filter 7 should not be so high as to suppress components that would be needed for proper operation of the W algorithm engine 9, the W filter 4 and the SE tracking or modeling (which tracks the secondary acoustic path).

In addition to the high-pass filter 7, there is a further high-pass filter 19, which may have essentially an identical counterpart in high-pass filter 17. These high-pass filters 17, 19 serve to once again remove some very low frequency components, so as to improve the ability to track the secondary acoustic path (via the SE tracking block, as shown in FIG. 7). This block is responsible for modeling the secondary acoustic path, and is able to produce coefficients for an adaptive digital filter that models the secondary acoustic path (where such filter is copied as SE modeling filter 11, as shown in FIG. 7). In other words, for the filtered-x LMS engine to work correctly, the reference and error signals need to be filtered in accordance with the high-pass filters 17, 19, respectively, prior to being used to either produce the coefficients of the SE modeling filter, or passing or driving through the SE modeling filter 11. As a result of these requirements, it can be seen that the location of the pre-shaping filters 8, 10 should be selected to be as shown in FIG. 7, namely just at the inputs of the algorithm engine 9, i.e. downstream of other filtering operations that have been performed upon the reference and error signals.

In one embodiment, still referring to FIG. 7, the reference signal first passes through the high-pass filter 7 which is a very low frequency high-pass filter (e.g., a knee at about 2 Hz), prior to then passing through a second high-pass filter 17 having a knee of between, for example, 100 Hz to about 200 Hz, and then passing through the SE copy filter 11 (which models the secondary acoustic path), prior to finally arriving at the pre-shaping filter PSF_1. As to the error side, the error signal from the error microphone may first pass through a high-pass filter 19, which may also have a knee of between 100 Hz-200 Hz, prior to then passing through the pre-shaping filter PSF_2. Locating PSF_1 and PSF_2 in this manner, namely just at their respective inputs of the W algorithm engine 9, allows the rest of the filtered-x LMS based ANC processor to continue to operate in accordance with, for example, any suitable conventional technique. In other words, the locations of PSF_1 and PSF_2, as shown in FIG. 7, should not effect otherwise conventional or normal operation of the LMS-based adaptive algorithm engine 9.

Finally, it should be noted that the pre-shaping filters PSF_1, PSF_2 may each be infinite impulse response filters, or they may be finite impulse response filters. It is expected that a phase response of PSF_1 should be similar to the phase response of PSF_2 so as to "match" the arrival of information at both inputs of the adaptive algorithm engine 9. In one embodiment, the pre-shaping filters may be substantially identical, and each may be comprised of two bi-quads (in an IIR implementation). One of the bi-quads may be a second order high-pass filter, while the other is a second order peaking filter with a peak at about 600 Hz, so as to emphasize the frequency range from 400 Hz to 800 Hz, as well as help suppress components below 400 Hz—see FIG. 5.

Figure 8:
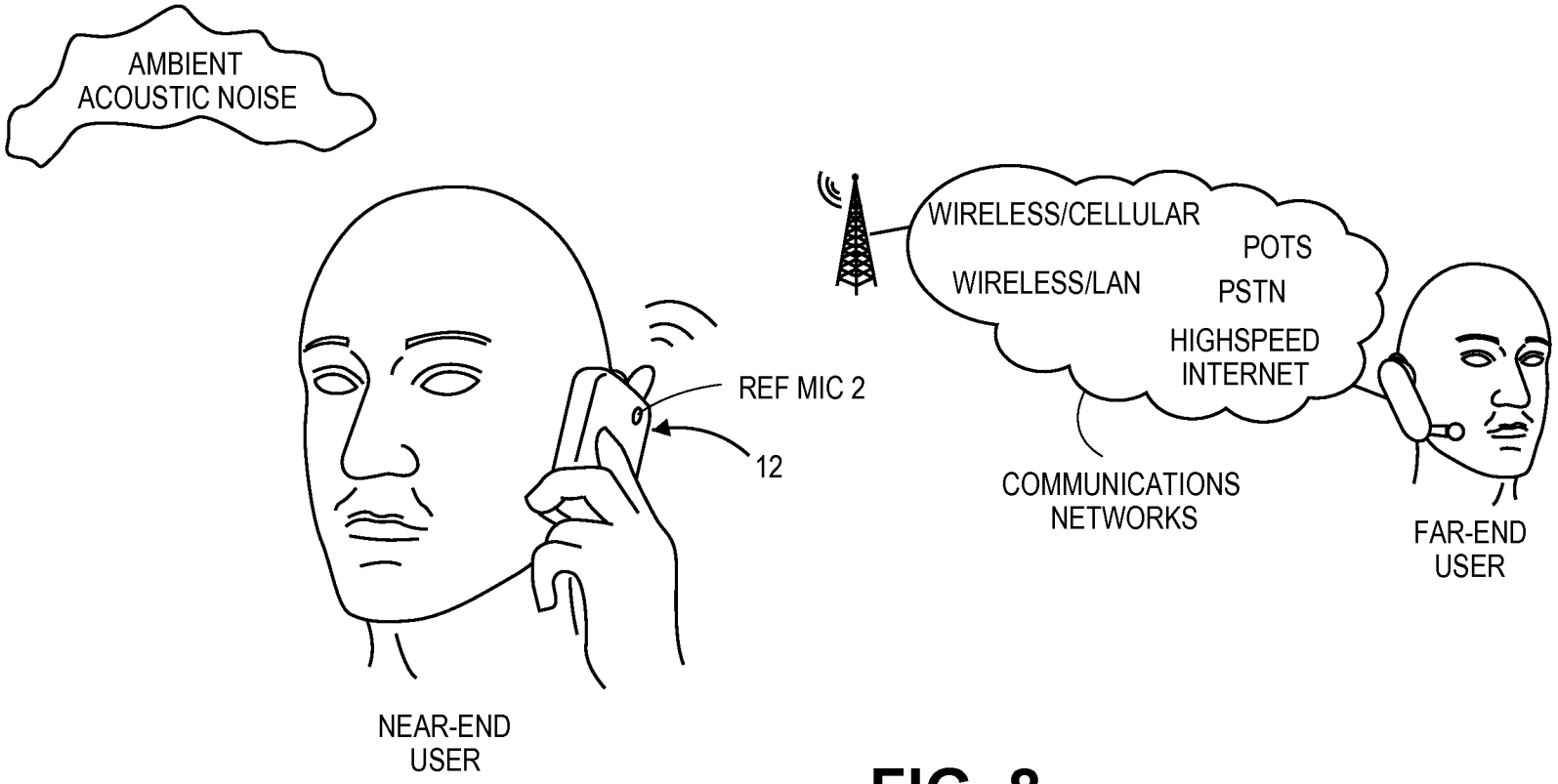
FIG. 8 shows an example of an end-user acoustic environment and consumer electronics product application of an ANC system.

FIG. 8 illustrates an example of an end-user acoustic environment and consumer electronics product application of an ANC system. A near-end user is holding a mobile communications handset device 12 such as a smart phone or a multi-function cellular phone. The ANC processor 1, the reference microphone 2 and the error microphone 3 (as well as the related processes described above) can be implemented in such a personal audio device. The near-end user is in the process of a call with a far-end user who is also using a user or personal communications device. The terms "call" and "telephony" are used here generically to refer to any two-way real-time or live audio communications session with a far-end user (including a video call which allows simultaneous audio). The term "mobile phone" is used generically here to refer to various types of mobile communications handset devices (e.g., a cellular phone, a portable wireless voice over IP device, and a smart phone). The mobile device 12 communicates with a wireless base station in the initial segment of its communication link. The call, however, may be conducted through multiple segments over one or more communication networks, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

The mobile device 12 has an exterior housing in which are integrated an earpiece speaker (which may be the speaker 5—see FIG. 1) near one side of the housing, and a primary handset (or talker) microphone 6 that is positioned near an opposite side of the housing. The mobile device 12 may also have a secondary microphone (which may be the reference microphone 2) located on a side or rear face of the housing and generally aimed in a different direction than the primary microphone 6, so as to better pickup the ambient sounds.

Figure 9:
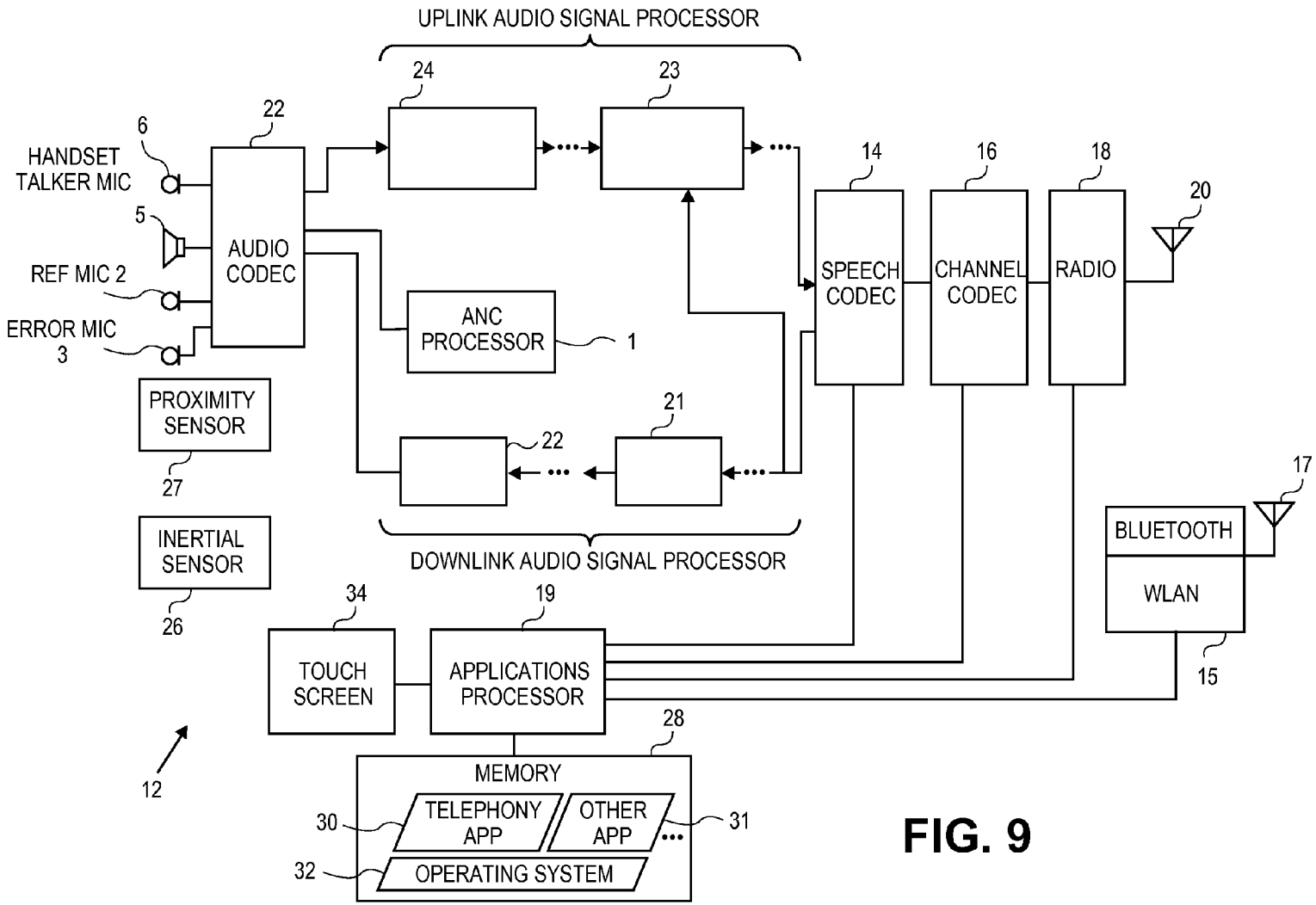
FIG. 9 is a block diagram of some relevant constituent components of a personal mobile communications device, such as a smart phone, in which an ANC processor may be implemented.

A block diagram of some of the functional unit blocks of the mobile device 12 is shown in FIG. 9. These include constituent hardware components such as those, for instance, of an iPhone™ device by Apple Inc. Although not shown, the mobile device 12 has a housing in which the primary mechanism for visual and tactile interaction with its user is a touch sensitive display screen (touch screen 34). As an alternative, a physical keyboard may be provided together with a display-only screen. The housing may be essentially a solid volume, often referred to as a candy bar or chocolate bar type, as in the iPhone™ device. Alternatively, a moveable, multi-piece housing such as a clamshell design or one with a sliding physical keyboard may be provided. The touch screen 34 can display typical user-level functions of visual voicemail, web browser, email, digital camera, various third party applications (or "apps"), as well as telephone features such as a virtual telephone number keypad that receives input from the user via touch gestures.

The user-level functions of the mobile device 12 are implemented under the control of an applications processor 19 or a system on a chip (SoC) processor that is programmed in accordance with instructions (code and data) stored in memory 28 (e.g., microelectronic non-volatile random access memory). The terms "processor" and "memory" are generically used here to refer to any suitable combination of programmable data processing components and data storage that can implement the operations needed for the various functions of the device described here. An operating system 32 may be stored in the memory 28, with several application programs, such as a telephony application 30 as well as other applications 31, each to perform a specific function of the device when the application is being run or executed. The telephony application 30, for instance, when it has been launched, unsuspended or brought to the foreground, enables a near-end user of the mobile device 12 to "dial" a telephone number or address of a communications device of the far-end user, to initiate a call, and then to "hang up" the call when finished.

For wireless telephony, several options are available in the mobile device 12 as depicted in FIG. 9. A cellular phone protocol may be implemented using a cellular radio 18 that transmits and receives to and from a base station using an antenna 20 integrated in the mobile device 12. As an alternative, the mobile device 12 offers the capability of conducting a wireless call over a wireless local area network (WLAN) connection, using the Bluetooth/WLAN radio transceiver 15 and its associated antenna 17. The latter combination provides the added convenience of an optional wireless Bluetooth headset link. Packetizing of the uplink signal, and depacketizing of the downlink signal, for a WLAN protocol, may be performed by the applications processor 19.

The uplink and downlink signals for a call that is being conducted using the cellular radio 18 can be processed by a channel codec 16 and a speech codec 14 as shown. The speech codec 14 performs speech coding and decoding in order to achieve compression of an audio signal, to make more efficient use of the limited bandwidth of typical cellular networks. Examples of speech coding include half-rate (HR), full-rate (FR), enhanced full-rate (EFR), and adaptive multi-rate wideband (AMR-WB). The latter is an example of a wideband speech coding protocol that transmits at a higher bit rate than the others, and allows not just speech but also music to be transmitted at greater fidelity due to its use of a wider audio frequency bandwidth. Channel coding and decoding performed by the channel codec 16 further helps reduce the information rate through the cellular network, as well as increase reliability in the event of errors that may be introduced while the call is passing through the network (e.g., cyclic encoding as used with convolutional encoding, and channel coding as implemented in a code division multiple access, CDMA, protocol). The functions of the speech codec 14 and the channel codec 16 may be implemented in a separate integrated circuit chip, some times referred to as a baseband processor chip. It should be noted that while the speech codec 14 and channel codec 16 are illustrated as separate boxes, with respect to the applications processor 19, one or both of these coding functions may be performed by the applications processor 19 provided that the latter has sufficient performance capability to do so.

The applications processor 19, while running the telephony application program 30, may conduct the call by enabling the transfer of uplink and downlink digital audio signals (also referred to here as voice or speech signals) between itself or the baseband processor on the network side, and any user-selected combination of acoustic transducers on the acoustic side. The downlink signal carries speech of the far-end user during the call, while the uplink signal contains speech of the near-end user that has been picked up by the handset talker microphone 6.

The analog-digital conversion interface between the acoustic transducers and the digital downlink and uplink signals may be accomplished by an audio codec 22. The acoustic transducers include an earpiece speaker (also referred to as a receiver) which may be the speaker 5, a loud speaker or speaker phone (not shown), one or more microphones including the talker microphone 6 that are intended to pick up the near-end user's speech primarily, a secondary microphone such as reference microphone 2 that is primarily intended to pick up the ambient or background sound, and the error microphone 3. The audio codec 22 may interface with the ANC processor 1 as shown, in that it outputs or provides the digital audio signals of reference microphone 2 and the error microphone 3 to the ANC processor 1, while receiving the anti-noise signal from the ANC processor 1. The audio codec 22 may then mix the anti-noise signal with the downlink audio (coming from the downlink audio signal processing chain) prior to driving a power amplifier that in turn drives the speaker 5.

The codec 22 may also provide coding and decoding functions for preparing any data that may need to be transmitted out of the mobile device 12 through a peripheral device connector such as a USB port (not shown), as well as data that is received into the mobile device 12 through that connector. The connector may be a conventional docking connector that is used to perform a docking function that synchronizes the user's personal data stored in the memory 28 with the user's personal data stored in the memory of an external computing system such as a desktop or laptop computer.

Still referring to FIG. 9, an audio signal processor is provided to perform a number of signal enhancement and noise reduction operations upon the digital audio uplink and downlink signals, to improve the experience of both near-end and far-end users during a call. This processor may be viewed as an uplink processor and a downlink processor, although these may be within the same integrated circuit die or package. Again, as an alternative, if the applications processor 19 is sufficiently capable of performing such functions, the uplink and downlink audio signal processors may be implemented by suitably programming the applications processor 19.

Various types of audio processing functions may be implemented in the downlink and uplink signal processing paths. The downlink signal path receives a downlink digital signal from either the baseband processor (and speech codec 14 in particular) in the case of a cellular network call, or the applications processor 19 in the case of a WLAN/VoIP call. The signal is buffered and is then subjected to various functions, which are also referred to here as a chain or sequence of functions. These functions are implemented by downlink processing blocks or audio signal processors that may include, one or more of the following which operate upon the downlink audio data stream or sequence: a noise suppressor, a voice equalizer, an automatic gain control unit, a compressor or limiter, and a side tone mixer.

The uplink signal path of the audio signal processor passes through a chain of several processors that may include an acoustic echo canceller, an automatic gain control block, an equalizer, a compander or expander, and an ambient noise suppressor. The latter is to reduce the amount of background or ambient sound that is in the talker signal coming from the primary microphone 6, using, for instance, the ambient sound signal picked up by a secondary microphone (e.g., reference microphone 2). Examples of ambient noise suppression algorithms are the spectral subtraction (frequency domain) technique where the frequency spectrum of the audio signal from the primary microphone 8 is analyzed to detect and then suppress what appear to be noise components, and the two microphone algorithm (referring to at least two microphones being used to detect a sound pressure difference between the microphones and infer that such is produced by noise rather than speech of the near-end user.

Figure 10:
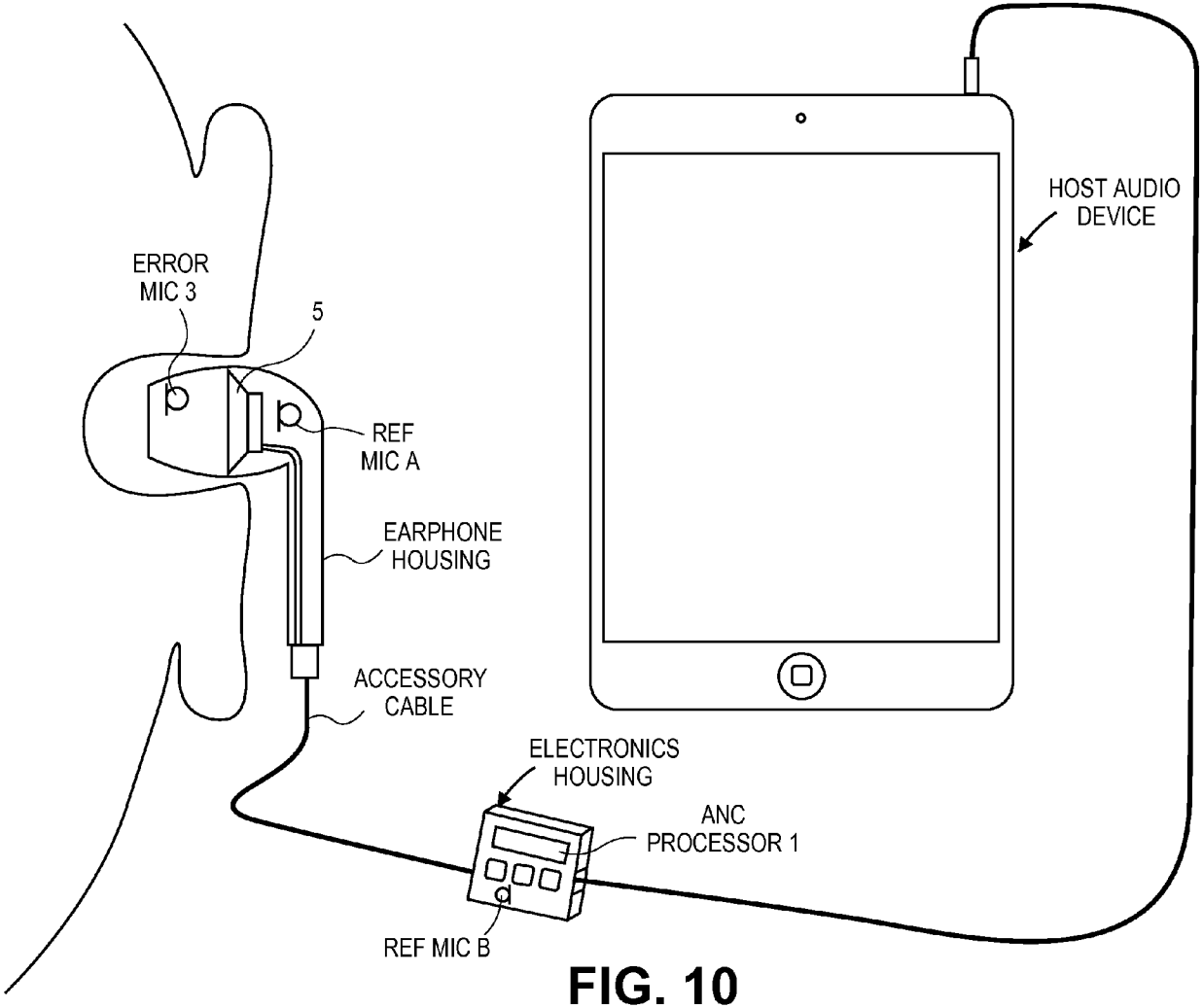
FIG. 10 illustrates another consumer electronics listening product in which the ANC system may be implemented.

FIG. 10 illustrates another consumer electronic listening product in which an ANC system may be implemented. A host audio device is shown, in this example being a tablet computer, that has a peripheral connector to which a headset is electrically connected via an accessory cable. The headset may include an in-the-ear earphone as shown, having an earphone housing in which the error microphone 3 and the reference microphone 2 (in this example ref mic A) are integrated. The speaker 5 in this case is a small or miniature speaker driver suitable for use within an earphone. In this case, there is a second reference microphone, ref mic B, that is located on the accessory cable somewhere between the earphone housing and the connector that is attached to the host audio device. Communication or signaling wires may connect the error microphone 3, ref mic A, ref mic B, and speaker 5 to the ANC processor 1 which in this case is integrated within a separate electronics housing (separate from the host device housing and the earphone housing) that is attached to the accessory cable. It is expected that the ANC processor 1 together with other electronics within this housing may receive dc power from a power supply circuit within the battery-powered host audio device, via the accessory cable. Other system applications of the ANC system within the realm of consumer electronics personal listening devices are possible.

As explained above, an embodiment of the invention may be a machine-readable medium (such as microelectronic memory) having stored thereon instructions, which program one or more data processing components (generically referred to here as a "processor") to perform the digital audio processing operations described above in connection with the ANC processor 1 including noise and signal strength measurement, filtering, mixing, adding, inversion, comparisons, and decision making. In other embodiments, some of these operations might be performed by specific hardware components that contain hardwired logic (e.g., dedicated digital filter blocks and hardwired state machines). Those operations might alternatively be performed by any combination of programmed data processing components and fixed hardwired circuit components.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. An audio apparatus comprising:

a reference microphone to produce a reference signal;

an error microphone to produce an error signal; and an active noise control (ANC) processor having an adaptive filter to use the reference signal and produce an anti-noise signal, an adaptive filter algorithm engine to configure digital filter coefficients of the adaptive filter in accordance with signals at a first input and a second input, a first pre-shaping filter to filter the reference signal at the first input, a second pre-shaping filter to filter the error signal at the second input, wherein each of the first and second pre-shaping filters has a high pass transfer function that is designed to suppress energy in a low frequency band, relative to a high frequency band, by having a knee between 100 Hz and 400 Hz and a roll-off slope between 10 dB/octave and 25 dB/octave.

2. The audio apparatus of claim 1 wherein the first and second pre-shaping filters together enable the engine to adapt the adaptive filter to thereby produce anti-noise in the high frequency band during the presence of focused or narrowband noise energy in the low frequency band, and wherein the low frequency band is 5 Hz to 400 Hz, and the high frequency band is 400 Hz to 1 kHz.

3. The audio apparatus of claim 2 wherein the focused noise energy is one of the group consisting of car noise, as picked up by the reference microphone while inside a car that has a running combustion engine and that is being driven, bus noise, train noise, and any other noise environment that has a focused or emphasized low frequency content.

4. The audio apparatus of claim 1 wherein the ANC processor further comprises:

a first high pass filter having a knee at less than 200 Hz that is to filter the reference signal, upstream of the first pre-shaping filter; and a second high pass filter having a knee at less than 200 Hz that is to filter the error signal, upstream of the second pre-shaping filter.

5. The audio apparatus of claim 4 wherein the ANC processor further comprises a third high pass filter having a knee no higher than 4 Hz, and wherein the output of the third high pass filter feeds both the first high pass filter and an input of the adaptive filter.

6. The audio apparatus of claim 1 wherein the first and second pre-shaping filters are one of a) infinite impulse response (IIR) filters and b) finite impulse response (FIR) filters.

7. A method for active noise control (ANC) that enables an adaptive filter algorithm engine that adapts a digital adaptive filter to produce anti-noise in a high frequency band during the presence of focused or narrowband noise energy in a low frequency band, comprising: pre-shaping a reference microphone signal in accordance with a transfer function with a high-pass section having a knee between 100 Hz and 500 Hz and a roll-off slope between 10 dB/octave and 25 dB/octave; pre-shaping an error microphone signal in accordance with a transfer function with a high-pass section having a knee between 100 Hz and 500 Hz and a roll-off slope between 10 dB/octave and 25 dB/octave; and performing an adaptive filter process to configure digital filter coefficients of an adaptive filter in accordance with the pre-shaped reference microphone signal and the pre-shaped error microphone signal.

8. The method of claim 7 further comprising high pass filtering the reference microphone signal in accordance with a transfer function having a knee below 4 Hz, and using the 4 Hz filtered reference microphone signal as an input signal of the adaptive filter.

9. The method of claim 8 wherein the adaptive filter models a primary acoustic path, the method further comprising:

high pass filtering the reference microphone signal in accordance with a transfer function having a knee below 200 Hz, and using the 200 Hz filtered reference microphone signal at an input of a further adaptive filter that models a secondary acoustic path.

10. A mobile phone comprising:

a mobile phone handset housing having therein an earpiece speaker;

an audio source to produce an audio user content signal;

a reference microphone to produce a reference signal;

an error microphone positioned closer to the earpiece speaker than the reference microphone to produce an error signal; and an active noise control (ANC) processor having an adaptive filter to use the reference signal to produce an anti-noise signal that is combined with the audio user content signal to drive the earpiece speaker, a first pre-shaping filter to filter the reference signal, a second pre-shaping filter to filter the error signal, an adaptive filter algorithm engine to configure filter coefficients of the adaptive filter in accordance with the filtered reference and error signals, wherein each of the first and second pre-shaping filters has a high pass transfer function that is designed to suppress energy in a low frequency band, relative to a high frequency band, to prevent instability of the ANC processor in the high frequency band during the presence of narrowband noise energy in the low frequency band, wherein the low frequency band is 5 Hz to 400 Hz, and the high frequency band is 400 Hz to 1 kHz, and wherein the high pass transfer function has a knee between 100 Hz and 400 Hz and a roll-off slope between 10 dB/octave and 25 dB/octave.

* * * * *